US008840110B2

(12) United States Patent
Tamura

(10) Patent No.: US 8,840,110 B2
(45) Date of Patent: Sep. 23, 2014

(54) SHEET CONVEYING DEVICE, IMAGE READING DEVICE PROVIDED WITH THE SAME, AND IMAGE FORMING APPARATUS PROVIDED WITH THE SAME

(71) Applicant: KYOCERA Document Solutions Inc., Osaka (JP)

(72) Inventor: Yuki Tamura, Osaka (JP)

(73) Assignee: KYOCERA Document Solutions, Inc., Osaka (JP)

( * ) Notice: Subject to any disclaimer, the term of this patent is extended or adjusted under 35 U.S.C. 154(b) by 0 days.

(21) Appl. No.: 14/149,858

(22) Filed: Jan. 8, 2014

(65) Prior Publication Data

US 2014/0191469 A1 Jul. 10, 2014

(30) Foreign Application Priority Data

Jan. 10, 2013 (JP) ..... 2013-002544

(51) Int. Cl.
*B65H 5/02* (2006.01)
*B65H 5/04* (2006.01)
*B65H 5/06* (2006.01)

(52) U.S. Cl.
CPC ..... *B65H 5/068* (2013.01)
USPC ..... 271/272; 271/273; 271/274

(58) Field of Classification Search
CPC ..... B65H 5/062; B65H 2601/11; B65H 2511/22; B65H 2511/224; B65H 2404/143; B65H 29/12; B65H 27/00; B65H 5/023; B65H 5/025
USPC ..... 271/272, 273, 274
See application file for complete search history.

(56) References Cited

U.S. PATENT DOCUMENTS 6,338,483 B1 * 1/2002 Andela et al. ..... 271/227
2004/0245715 A1 * 12/2004 Zheng ..... 271/274
2008/0036141 A1 * 2/2008 Liu et al. ..... 271/274

FOREIGN PATENT DOCUMENTS

JP 04159941 A * 6/1992 ..... B65H 5/06
JP 2001-19209 1/2001

* cited by examiner

*Primary Examiner* — Prasad Gokhale
(74) *Attorney, Agent, or Firm* — Gerald E. Hespos; Michael J. Porco; Matthew T. Hespos

(57) ABSTRACT

A sheet conveying device is provided with a housing including a contact portion, a sheet conveyance path, a drive roller, a driven roller, and a support member. The driven roller is made of a resin material, and is provided with a roller portion, and a pair of shaft portions. The support member is made of a metal material and rotatably supports the driven roller. The support member includes a pair of ring portions through which each of the shaft portions is inserted, and a pair of arm portions extending in one direction from the paired ring portions and supported on the housing. The driven roller is rotated with the drive roller in a state that a downstream outer portion of the ring portion in the conveying direction is contacted with the contact portion of the housing.

18 Claims, 8 Drawing Sheets

SHEET CONVEYING DEVICE, IMAGE READING DEVICE PROVIDED WITH THE SAME, AND IMAGE FORMING APPARATUS PROVIDED WITH THE SAME

This application relates to and claims priority from Japanese Patent Application No. 2013-002544, filed in the Japan Patent Office on Jan. 10, 2013, the entire disclosure of which is incorporated herein by reference.

BACKGROUND

The present disclosure relates to a sheet conveying device for conveying sheets, an image reading device provided with the sheet conveying device, and an image forming apparatus provided with the sheet conveying device.

An image forming apparatus utilizing electrophotography such as a copying machine, a printer, and a facsimile machine is configured to form a toner image by supplying a developer onto an electrostatic latent image formed on an image carrier (such as a photosensitive drum or a transfer belt) and by developing the electrostatic latent image. The toner image on the image carrier is transferred onto a sheet by a transfer device. The sheet carrying the transferred toner image is conveyed to a fixing device. After the sheet is subjected to a fixing process in the fixing device, the sheet is discharged onto a predetermined sheet discharge portion.

In the thus-configured image forming apparatus, the sheet is conveyed from a sheet storing portion to a transfer position facing the transfer device. Then, the sheet is conveyed to the sheet discharge portion from the transfer position via the fixing device. Conventionally, there is known a technology, in which a sheet is conveyed while being held by a drive roller which is driven and rotated, and a driven roller which is driven and rotated with the drive roller. The drive roller is provided with a rubber layer on an outer surface thereof to have a predetermined friction coefficient with respect to the sheet. On the other hand, in many cases, the driven roller is made of a resin material.

Conventionally, there is known a technology, in which a driven roller is pressed against a drive roller, while being rotatably supported by a support member constituted of a plate spring. The support member has one end thereof which supports the driven roller, and has the other end thereof which is screw-fastened to a casing. Further, a shaft of the driven roller is inserted in a groove-shaped bearing member made of a resin material to rotatably support the driven roller. Furthermore, the driven roller is pressed against the drive roller by urging the plate spring toward the shaft of the driven roller.

In the aforementioned technology, there may be generated noise caused by contact between the shaft of the driven roller and a bearing portion by a long period of use in a state that the shaft of the driven roller is inserted in the groove-shaped bearing member made of a resin material.

An object of the present disclosure is to provide a sheet conveying device that enables to suppress generation of noise caused by contact between resin members in a bearing portion of a driven roller.

SUMMARY

A sheet conveying device according to an aspect of the present disclosure is provided with a housing including a contact portion, a sheet conveyance path, a drive roller, a driven roller, and a support member. The sheet conveyance path extends in the housing, and a sheet is conveyed in a predetermined conveying direction along the sheet conveyance path. The drive roller is supported by the housing, and configured to convey the sheet in the conveying direction by driven and rotated. The driven roller is made of a resin material, and is provided with a roller portion, and a pair of shaft portions projecting from both side surfaces of the roller portion. The driven roller is disposed to face the drive roller across the sheet conveyance path, and is rotated around the shaft portions with the drive roller. The support member is made of a metal material, and includes a pair of ring portions through which each of the shaft portions is inserted, and a pair of arm portions extending in one direction from the paired ring portions and supported on the housing. The support member rotatably supports the driven roller. The driven roller is rotated with the drive roller in a state that a downstream outer portion of the ring portion in the conveying direction is contacted with the contact portion of the housing.

An image forming apparatus according to another aspect of the present disclosure is provided with the aforementioned sheet conveying device, and an image forming assembly which forms an image on a sheet.

An image reading device according to yet another aspect of the present disclosure is provided with the aforementioned sheet conveying device, and a reading mechanism. The sheet conveying device is configured to convey a sheet having a document image to a predetermined document reading position. The reading mechanism is configured to read the document image at the document reading position.

These and other objects, features and advantages of the present disclosure will become more apparent upon reading the following detailed description along with the accompanying drawings.

DETAILED DESCRIPTION

Figure 1:
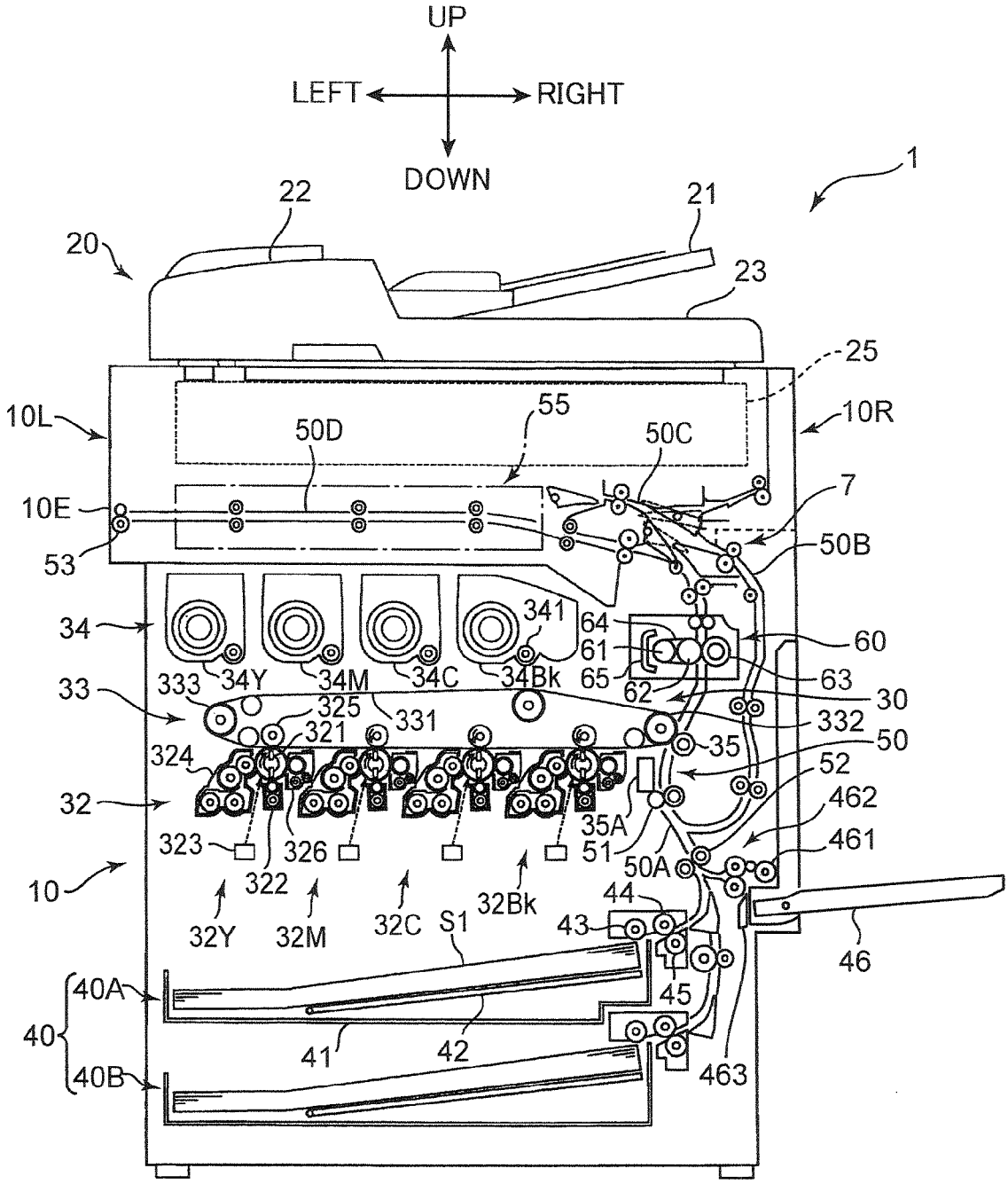
FIG. 1 is a cross-sectional view showing an internal structure of an image forming apparatus embodying the present disclosure.

In the following, an embodiment of the present disclosure is described in detail referring to the drawings. FIG. 1 is a cross-sectional view showing an internal structure of an image forming apparatus 1 embodying the present disclosure. In this example, the image forming apparatus 1 is a complex machine provided with a function of a printer and a function of a copying machine. The image forming apparatus may be a printer, a copying machine, or a facsimile machine.

<Description of Image Forming Apparatus>

The image forming apparatus 1 is provided with an apparatus body 10 having a substantially rectangular parallelepiped housing structure, and an automatic document feeder 20 disposed above the apparatus body 10. The apparatus body 10 is internally provided with a reading unit 25 which optically reads a document image to be copied, an image forming assembly 30 which forms a toner image onto a sheet, a fixing portion 60 which fixes the toner image on the sheet, a sheet stacking portion 40 which stores sheets of a fixed size to be conveyed to the image forming assembly 30, a conveyance path 50 along which a sheet of a fixed size is conveyed from the sheet stacking portion 40 or from a sheet feeding tray 46 to a sheet discharge port 10E via the image forming assembly 30 and the fixing portion 60, and a conveyance unit 55 in which a sheet conveyance path constituting a part of the conveyance path 50 is formed.

The automatic document feeder (ADF) 20 is pivotally mounted on an upper surface of the apparatus body 10. The ADF 20 automatically feeds a document sheet to be copied toward a predetermined document reading position in the apparatus body 10. On the other hand, in the case where the user manually places a document sheet at the predetermined document reading position, the ADF 20 is opened upwardly. The ADF 20 includes a document tray 21 on which a document sheet is placed, a document conveying portion 22 which conveys the document sheet via the automatic document reading position, and a document discharge tray 23 on which the document sheet after an image reading operation is discharged.

The reading unit 25 (a reading mechanism) optically reads an image of a document sheet through a first contact glass (not shown) for reading a document sheet which is automatically fed from the ADF 20 disposed above the apparatus body 10, or through a second contact glass (not shown) for reading a manually placed document sheet. The reading unit 25 houses therein a scanning mechanism including a light source, a moving carriage, and a reflection mirror, and an imaging element, all of which are not illustrated. The scanning mechanism irradiates light onto a document sheet, and guides light reflected on the document sheet to the imaging element. The imaging element photoelectrically converts the reflected light into an analog electric signal. After the analog electric signal is converted into a digital electric signal by an A/D conversion circuit, the digital electric signal is inputted to the image forming assembly 30.

The image forming assembly 30 is configured to generate a full-color toner image and to transfer the toner image onto a sheet. The image forming assembly 30 includes an image forming unit 32 constituted of tandemly disposed four units 32Y, 32M, 32C, and 32Bk for forming the respective toner images of yellow (Y), magenta (M), cyan (C), and black (Bk), an intermediate transfer unit 33 disposed adjacent to and above the image forming unit 32, and a toner replenishing portion 34 disposed above the intermediate transfer unit 33.

Each of the image forming units 32Y, 32M, 32C, and 32Bk includes a photosensitive drum 321, and further includes a charger 322, an exposure unit 323, a developing device 324, a primary transfer roller 325, and a cleaning device 326 disposed around the photosensitive drum 321.

The photosensitive drum 321 rotates about an axis thereof, and forms an electrostatic latent image and a toner image on the circumferential surface thereof. An example of the photosensitive drum 321 is a photosensitive drum made of an amorphous silicon (a-Si) based material. The charger 322 uniformly charges the surface of the photosensitive drum 321. The exposure unit 323 has an optical device such as a laser light source, a mirror, and a lens. The exposure unit 323 forms an electrostatic latent image by irradiating light based on image data indicative of a document image onto the circumferential surface of the photosensitive drum 321.

The developing device 324 supplies toner to the circumferential surface of the photosensitive drum 321 for developing an electrostatic latent image formed on the photosensitive drum 321. A two-component developer is used in the developing device 324. The developing device 324 includes screw feeders, a magnetic roller, and a developing roller.

The primary transfer roller 325 forms a nip portion with the photosensitive drum 321 in a state that an intermediate transfer belt 331 provided in the intermediate transfer unit 33 is interposed between the primary transfer roller 325 and the photosensitive drum 321, and transfers the toner image on the photosensitive drum 321 onto the intermediate transfer belt 331. The cleaning device 326 has a cleaning roller, and cleans the circumferential surface of the photosensitive drum 321 after the toner image transfer.

The intermediate transfer unit 33 is provided with the intermediate transfer belt 331, a transfer drive roller 332, and a transfer driven roller 333. The intermediate transfer belt 331 is an endless belt wound around the transfer drive roller 332 and the transfer driven roller 333. Toner images are transferred one over the other at a same position from the photosensitive drums 321 onto an outer surface of the intermediate transfer belt 331 (primary transfer).

A secondary transfer roller 35 is disposed to face the outer surface of the transfer drive roller 332. A nip portion defined by the transfer drive roller 332 and the secondary transfer roller 35 serves as a secondary transfer portion, in which a full-color toner image obtained by transferring the toner images one over the other on the intermediate transfer belt 331 is transferred onto a sheet. A secondary transfer bias voltage having a polarity opposite to the polarity of a toner image is applied to one of the transfer drive roller 332 and the secondary transfer roller 35, and the other of the transfer drive roller 332 and the secondary transfer roller 35 is grounded.

The toner replenishing portion 34 includes a yellow toner container 34Y, a magenta toner container 34M, a cyan toner container 34C, and a black toner container 34Bk. These toner containers 34Y, 34C, 34M, and 34Bk respectively store toners of the respective colors, and supply the toners of the respective colors to the developing devices 324 in the image forming units 32Y, 32M, 32C, and 32Bk corresponding to the respective colors of Y, M, C, and Bk via an unillustrated toner feeding path. Each of the toner containers 34Y, 34C, 34M, and 34Bk is provided with a conveyor screw 341 which conveys the toner therein to an unillustrated toner discharge port. Toners are replenished into the respective developing devices 324 by driving and rotating the conveyor screws 341 by an unillustrated driving portion.

The sheet stacking portion 40 is provided with two cassettes i.e. a first sheet cassette 40A and a second sheet cassette 40B, each of which is configured to store sheets S1 of a fixed size, out of the sheets of different sizes for image formation. The user is allowed to draw out the first and second sheet cassettes 40A and 40B in forward direction from the front side of the apparatus body 10.

The first sheet cassette 40A is provided with a sheet storing portion 41 for storing a sheet stack constituted of a stack of sheets S1 of a fixed size, and a lift plate 42 for lifting up the sheet stack for sheet feeding. A pickup roller 43, and a roller pair constituted of a feeding roller 44 and a retard roller 45 are disposed on an upper portion on the right end side of the sheet cassette 40A. Driving the pickup roller 43 and the feeding roller 44 makes it possible to dispense the sheet stack in the sheet cassette 40A one by one from the uppermost sheet S1, whereby the uppermost sheet S1 is conveyed to an upstream end of the conveyance path 50. The second sheet cassette 40B has the same construction as the first sheet cassette 40A.

A sheet feeding tray 46 for manual sheet feeding is provided on a right surface 10R of the apparatus body 10. The sheet feeding tray 46 is mounted on the apparatus body 10 to be pivotally opened and closed around a lower end of the sheet feeding tray 46. In the case where the user performs manual sheet feeding, the user opens the sheet feeding tray 46 as shown in FIG. 1, and places a sheet or sheets on the sheet feeding tray 46. The sheet placed on the sheet feeding tray 46 is conveyed to the conveyance path 50 by driving of a pickup roller 461 and a sheet feeding roller 462.

The conveyance path 50 is provided with a main conveyance path 50A along which a sheet (a sheet S1 of a fixed size) is conveyed from the sheet stacking portion 40 to the exit of the fixing portion 60 via the image forming assembly 30, an inversion conveyance path 50B for returning a sheet after image printing on one surface thereof to the image forming assembly 30 in the case where the sheet is subjected to double-sided printing, a switchback conveyance path 50C for directing the sheet from a downstream end of the main conveyance path 50A to an upstream end of the inversion conveyance path 50B, and a horizontal conveyance path 50D for conveying the sheet in a horizontal direction from the downstream end of the main conveyance path 50A to the sheet discharge port 10E formed in a left surface 10L of the apparatus body 10. A main part of the horizontal conveyance path 50D is constituted of a sheet conveyance path formed in the conveyance unit 55.

A registration roller pair 51 is disposed on the upstream side of the main conveyance path 50A than a secondary transfer portion 35A. Conveying of a sheet is temporarily stopped by the registration roller pair 51 in a stopped state for skew correction. Thereafter, the sheet is fed to the secondary transfer portion at a predetermined timing for image transfer by driving and rotating the registration roller pair 51 by a drive motor (not shown). In addition to the above, plural conveyor rollers 52 for conveying a sheet are disposed along the main conveyance path 50A.

A sheet discharge roller 53 is disposed at a most downstream end of the conveyance path 50. The sheet discharge roller 53 is configured to feed a sheet to an unillustrated post-processing device disposed on the left surface 10L of the apparatus body 10 through the sheet discharge port 10E. In the case where an image forming apparatus is not provided with a post-processing device, a sheet discharge tray is provided at a position below the sheet discharge port 10E.

The conveyance unit 55 is a unit for conveying a sheet conveyed out of the fixing portion 60 to the sheet discharge port 10E. The image forming apparatus 1 of the embodiment is configured such that the fixing portion 60 is disposed on the right surface 10R side of the apparatus body 10, and the sheet discharge port 10E is formed on the left surface 10L side of the apparatus body 10 facing the right surface 10R. By the above configuration, the conveyance unit 55 conveys a sheet in a horizontal direction from the right surface 10R of the apparatus body 10 toward the left surface 10L thereof.

The fixing portion 60 is an inductive heating fixing device which performs a fixing process of fixing a toner image on a sheet. The fixing portion 60 includes a heating roller 61, a fixing roller 62, a pressing roller 63, a fixing belt 64, and an inductive heating unit 65. The pressing roller 63 is brought into pressing contact with the fixing roller 62 to thereby form a fixing nip portion. The heating roller 61 and the fixing belt 64 are inductively heated by the inductive heating unit 65 for applying the heat from the inductive heating unit 65 to the fixing nip portion. A toner image transferred onto a sheet is fixed on the sheet, while the sheet is allowed to pass the fixing nip portion.

Further, the image forming apparatus 1 is provided with a conveyance unit 7 (a sheet conveying device) for conveying a sheet. The conveyance unit 7 is provided with a pair of rollers for conveying a sheet subjected to a switchback operation in the switchback conveyance path 50C to the inversion conveyance path 50B.

<Configuration of Conveyance Unit 7>

Figure 2:
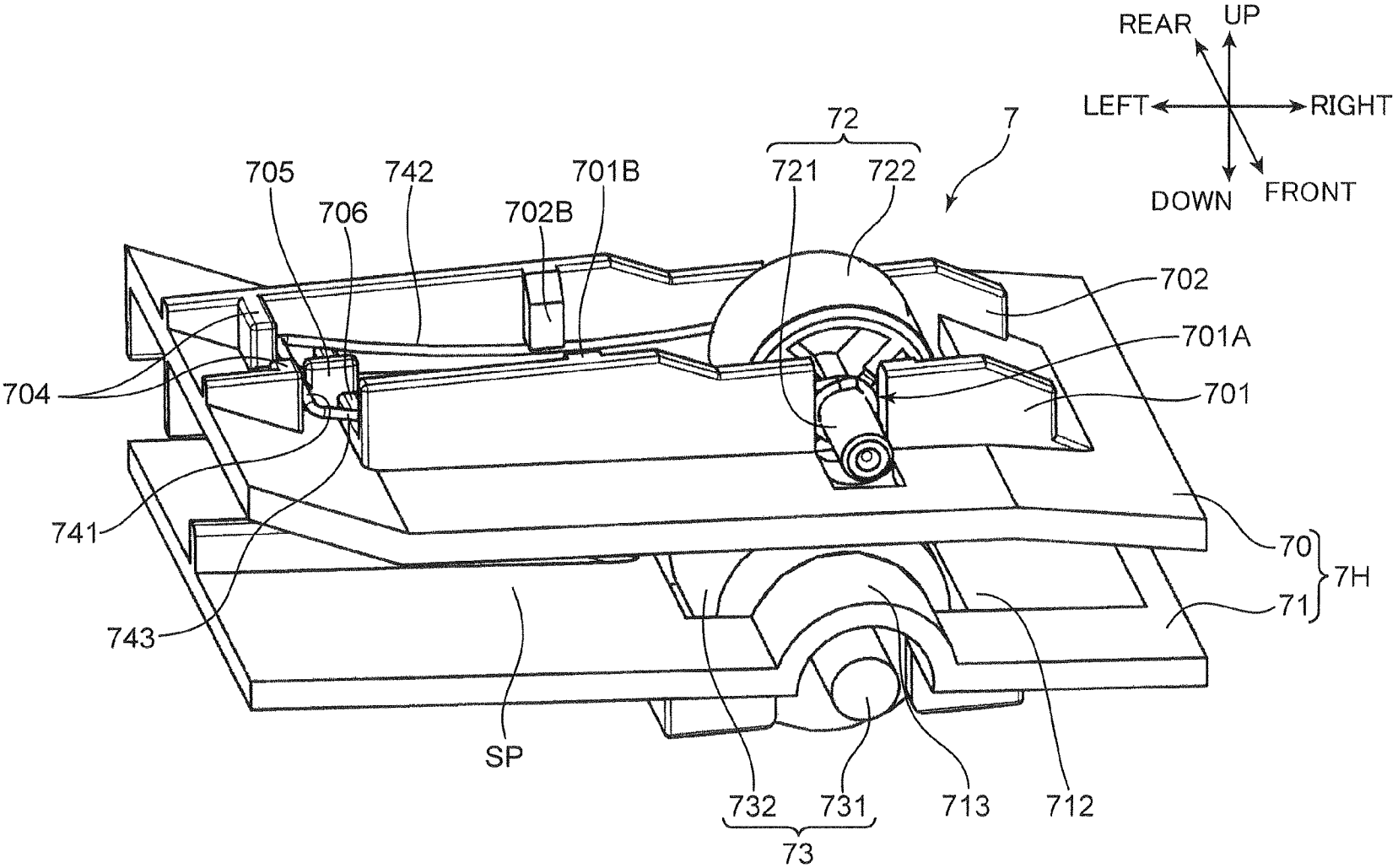
FIG. 2 is a perspective view of a sheet conveying device embodying the present disclosure.
Figure 3:
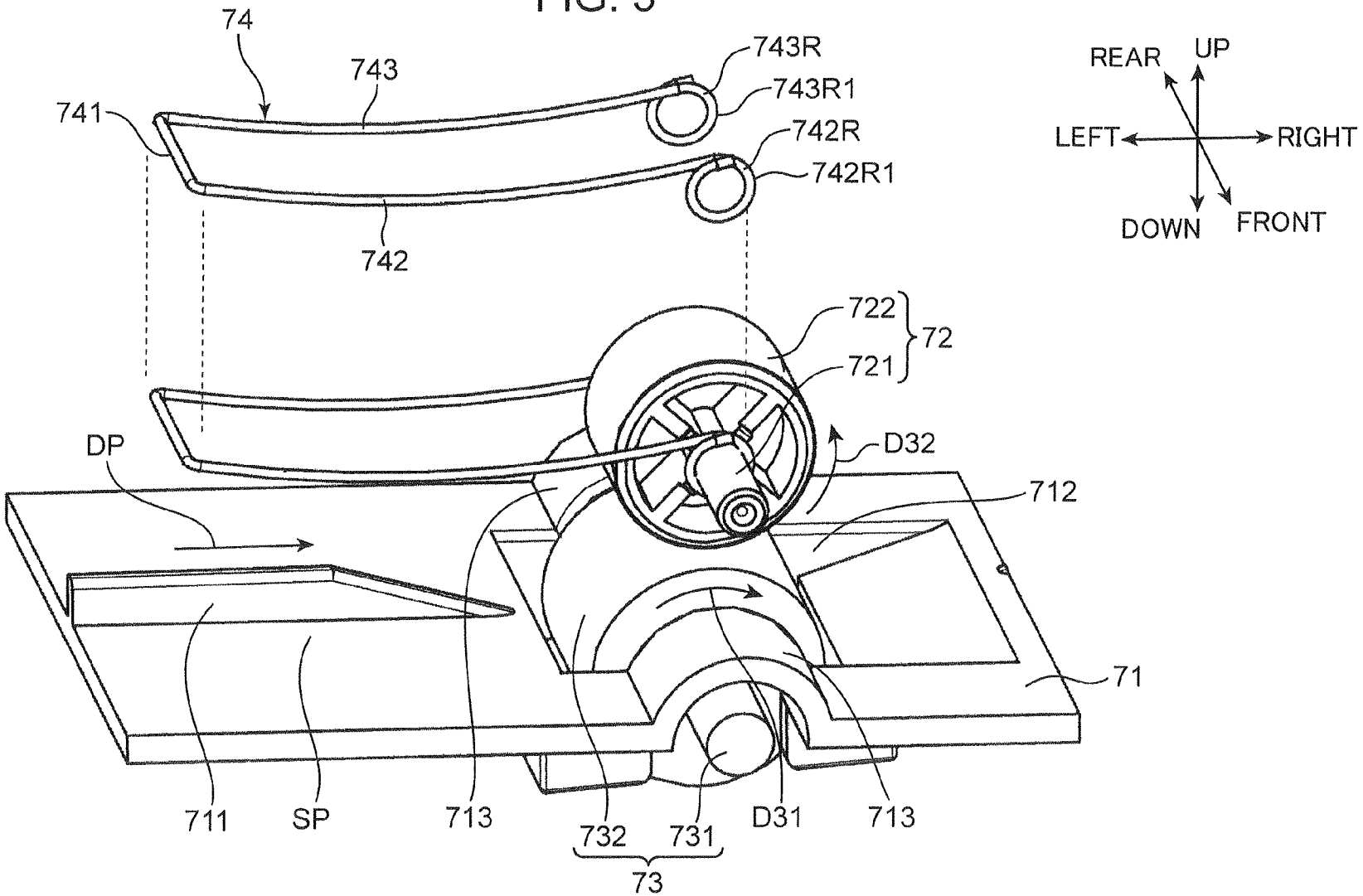
FIG. 3 is an exploded perspective view of the sheet conveying device embodying the present disclosure.
Figure 4:
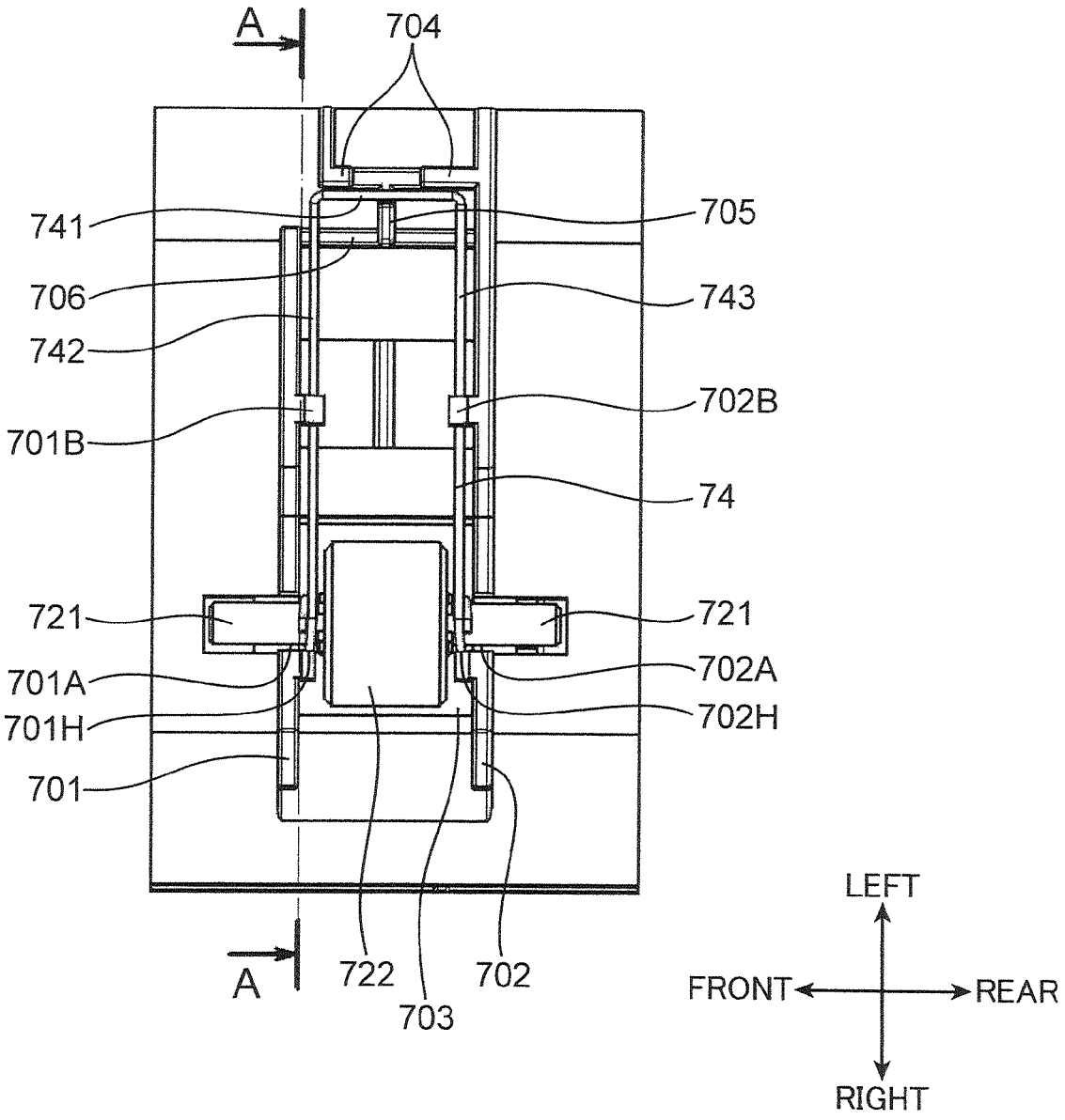
FIG. 4 is a plan view of the sheet conveying device embodying the present disclosure.
Figure 5:
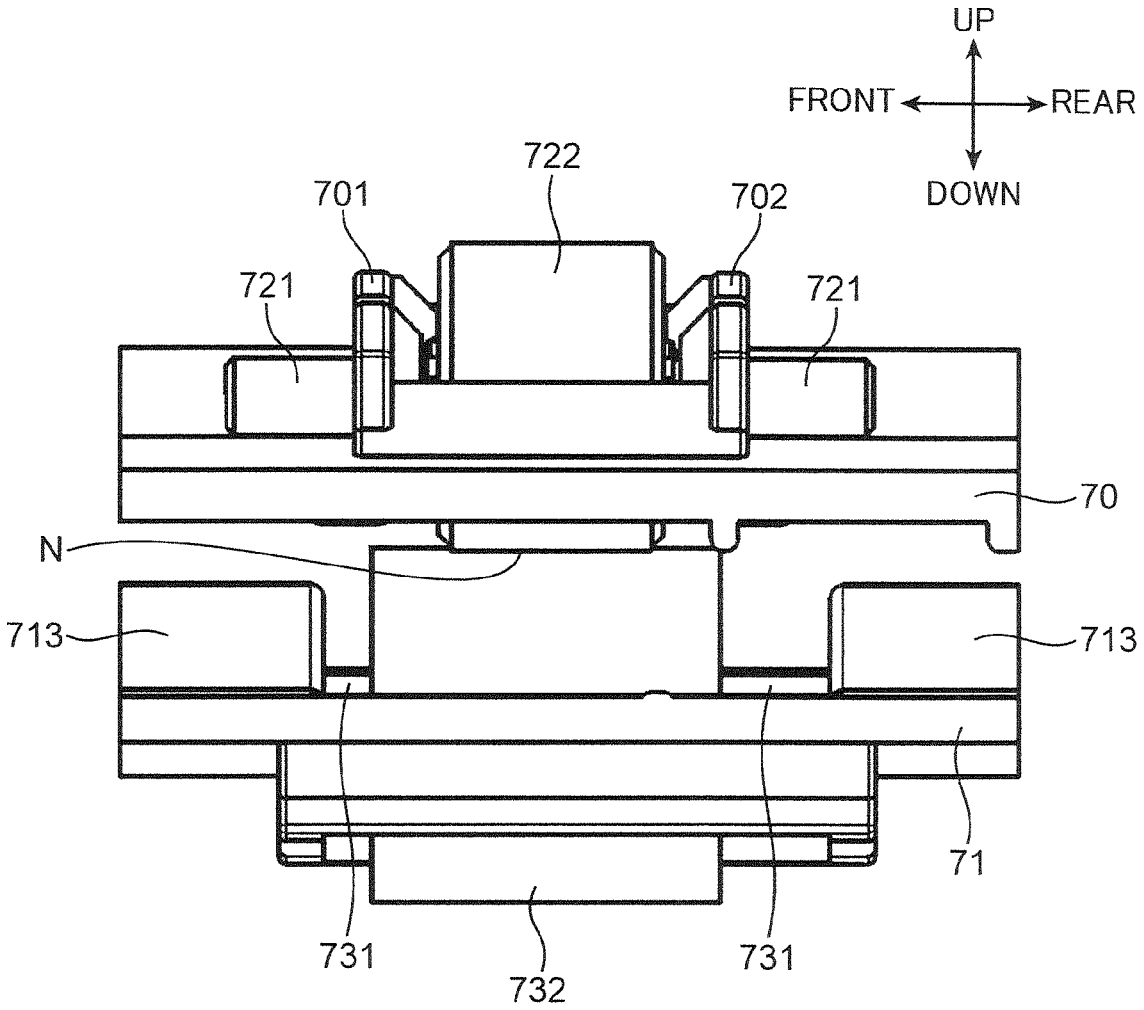
FIG. 5 is a side view of the sheet conveying device embodying the present disclosure.
Figure 6:
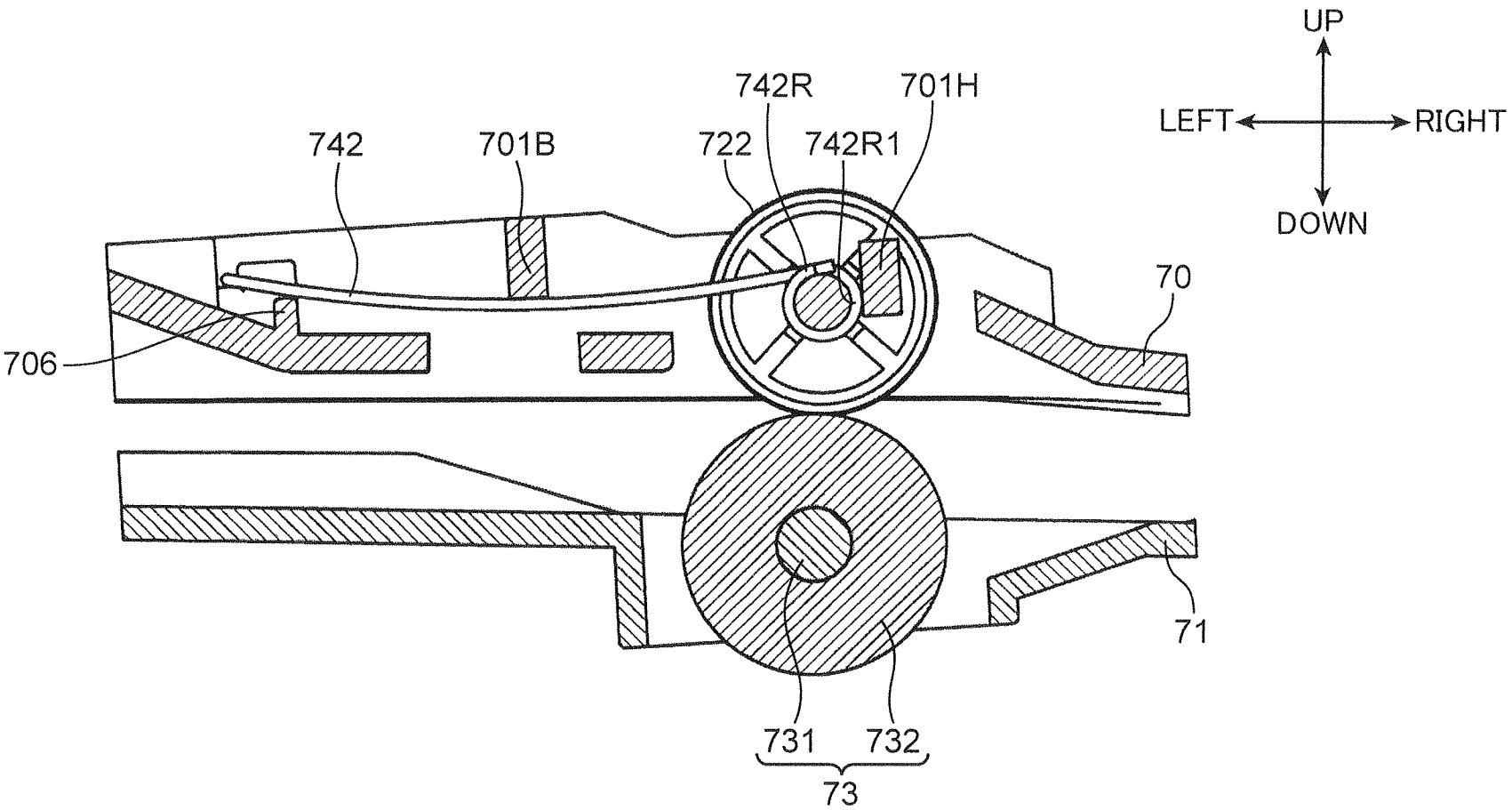
FIG. 6 is a cross-sectional view of the sheet conveying device embodying the present disclosure.
Figure 7:
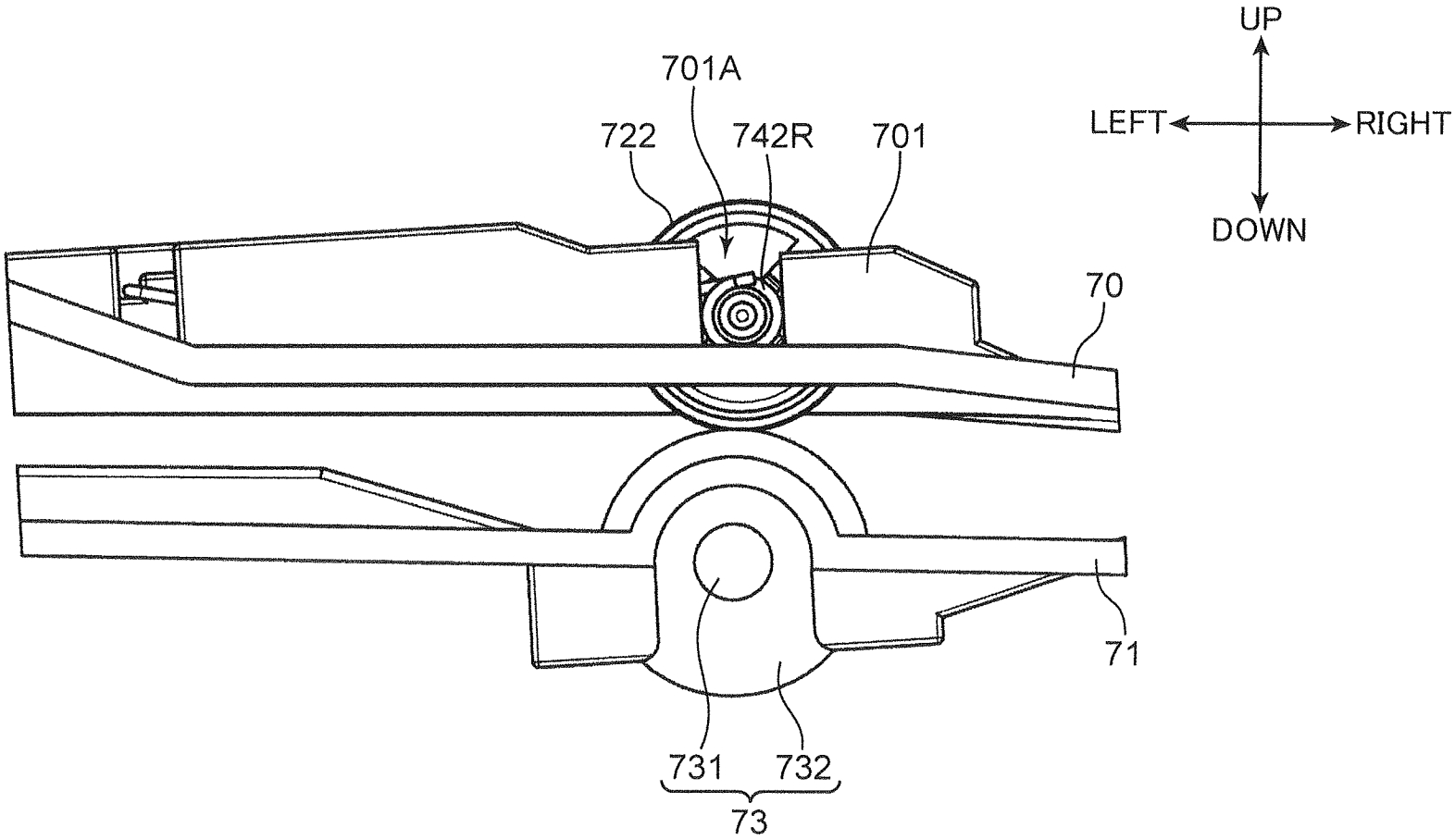
FIG. 7 is a front view of the sheet conveying device embodying the present disclosure.
Figure 8:
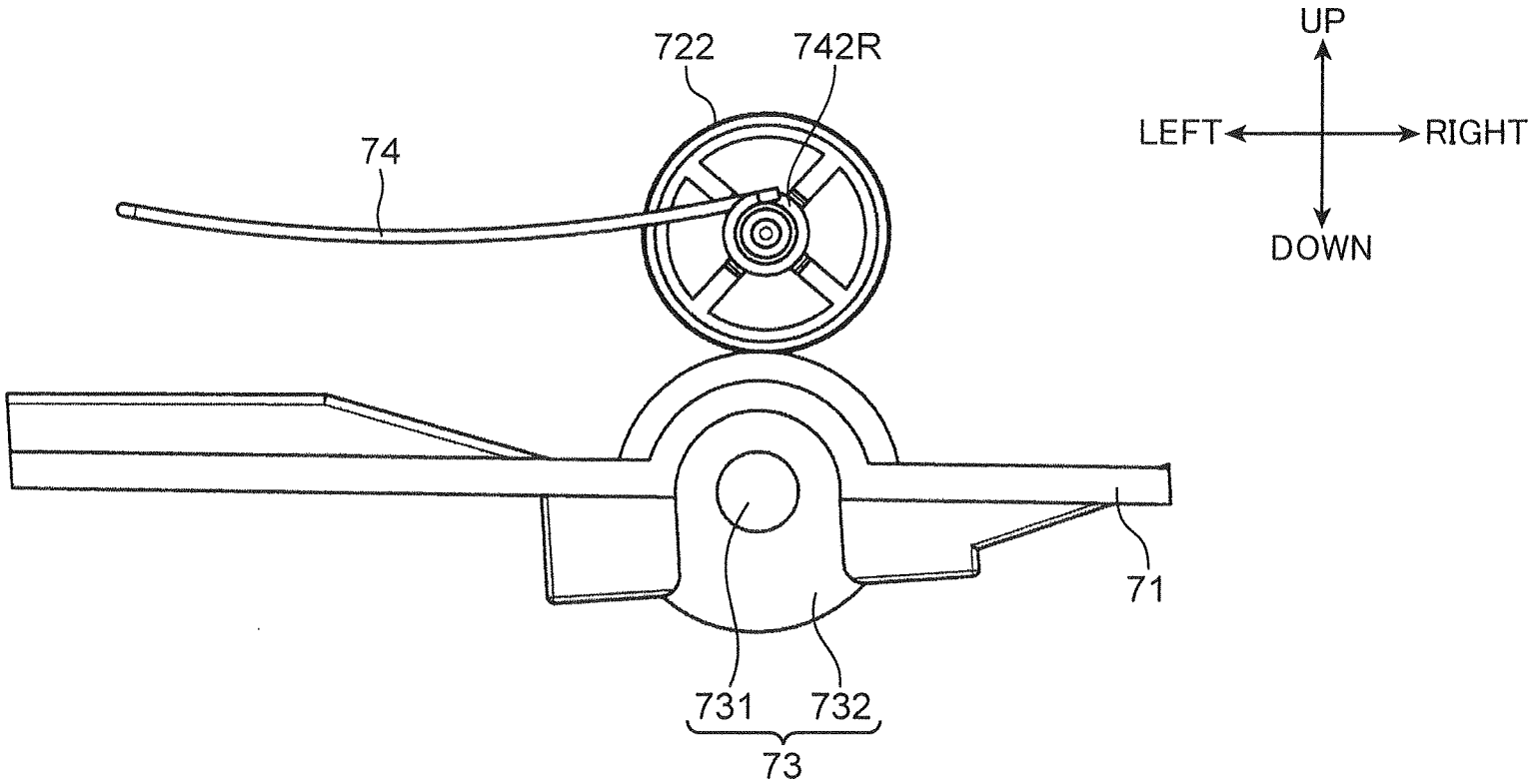
FIG. 8 is a partial front view of the sheet conveying device embodying the present disclosure.

In the following, the conveyance unit 7 (a sheet conveying device) of the embodiment is described in details. FIG. 2 is a perspective view of the conveyance unit 7 according to the embodiment. FIG. 3 is an exploded perspective view of the conveyance unit 7. FIG. 3 shows a state that an upper housing 70 to be described later is dismounted. FIG. 4 is a plan view of the conveyance unit 7. FIG. 5 is a side view of the conveyance unit 7. FIG. 6 is a cross-sectional view of the conveyance unit 7. FIG. 7 is a front view of the conveyance unit 7. FIG. 8 is a partially front view of the conveyance unit 7. FIG. 8 shows a state that the upper housing 70 to be described later is dismounted.

The conveyance unit 7 is provided with a housing 7H, a driven roller 72, a drive roller 73, and a wire spring 74. The housing 7H supports the driven roller 72 and the drive roller 73. The housing 7H is constituted of the upper housing 70 (a plate portion), and a lower housing 71. A sheet conveyance path SP along which a sheet is conveyed is formed between the upper housing 70 and the lower housing 71 of the housing 7H. In this embodiment, as shown in FIG. 3, a sheet is conveyed along the sheet conveyance path SP in the arrow DP direction (a conveying direction).

The upper housing 70 of the housing 7H is disposed above the sheet conveyance path SP. The upper housing 70 is constituted of a plate-like member extending in left and right directions, with a predetermined width in front and rear directions. The upper housing 70 rotatably supports the driven roller 72 via the wire spring 74 to be described later. The upper housing 70 is provided with a front wall 701 (a first wall portion), a rear wall 702 (a first wall portion), an upper opening portion 703 (see FIG. 4) (a first opening portion), a left wall 704 (a second wall portion), an engaging projecting portion 705, and a support wall portion 706.

The front wall 701 and the rear wall 702 are a pair of wall portions extending in left and right directions at an upper surface portion of the upper housing 70. The front wall 701 and the rear wall 702 are disposed to be away from each other by a predetermined distance in front and rear directions. The front wall 701 and the rear wall 702 are respectively formed with a first insertion portion 701A (a second opening portion) and a second insertion portion 702A (a second opening portion) (see FIG. 2 and FIG. 4). The first insertion portion 701A and the second insertion portion 702A are respectively opening portions opened on a slightly right side with respect to middle parts of the front wall 701 and the rear wall 702 in left and right directions. A driven shaft 721 of the driven roller 72 is inserted in the first insertion portion 701A and the second insertion portion 702A. Further, the front wall 701 and the rear wall 702 are respectively provided with a first claw portion 701B and a second claw portion 702B (claw portions, a second support portion). The first claw portion 701B and the second claw portion 702B are respectively projecting portions projecting from inner side surfaces of the front wall 701 and the rear wall 702 to face each other. The first claw portion 701B and the second claw portion 702B extend in up and down directions. Further, a first spring portion 742 and a second spring portion 743 of the wire spring 74 to be described later are respectively engaged with lower ends of the first claw portion 701B and the second claw portion 702B.

The upper opening portion 703 is an opening portion formed through the upper housing 70 in up and down directions between the front wall 701 and the rear wall 702. The upper opening portion 703 is disposed between the first insertion portion 701A and the second insertion portion 702A in top plan view shown in FIG. 4. The driven shaft 721 of the driven roller 72 is inserted through the first insertion portion 701A and the second insertion portion 702A from above, and a driven roller portion 722 of the driven roller 72 is inserted through the upper opening portion 703 from above. By the configuration, the driven roller portion 722 is exposed to the sheet conveyance path SP.

The left wall 704 is a wall portion disposed on the left side (on the upstream side in the sheet conveying direction) relative to the front wall 701 and the rear wall 702, and on the left side away from the upper opening portion 703 (the driven roller portion 722) by a predetermined distance. The left wall 704 projects upwardly from the upper housing 70, and extends along front and rear directions (in the sheet width direction). In this embodiment, a middle part of the left wall 704 in front and rear directions is partially cut away.

The engaging projecting portion 705 is a projecting portion disposed on the right side of the left wall 704 at a position away from the left wall 704 by a predetermined distance. The engaging projecting portion 705 extends toward the upstream side in the sheet conveying direction at a middle part between the front wall 701 and the rear wall 702. A base end portion 741 of the wire spring 74 to be described later is inserted in a space between the engaging projecting portion 705 and the left wall 704.

The support wall portion 706 (a first support portion) is a wall portion standing upright between the front wall 701 and the rear wall 702 to project from a right end of the engaging projecting portion 705 in front and rear directions. The support wall portion 706 extends upwardly from the upper housing 70 with a height lower than the front wall 701, the rear wall 702, and the engaging projecting portion 705. The support wall portion 706 supports the first spring portion 742 and the second spring portion 743 of the wire spring 74 to be described later. In other words, the support wall portion 706 presses the first spring portion 742 and the second spring portion 743 in such a manner that the first spring portion 742 and the second spring portion 743 are directed upwardly (in a direction away from the sheet conveyance path SP).

The lower housing 71 of the housing 7H is disposed below the sheet conveyance path SP. The lower housing 71 is a plate-like member extending in left and right directions, with a predetermined width in front and rear directions. The lower housing 71 rotatably supports the drive roller 73. The lower housing 71 is provided with a rib 711, a lower opening portion 712, and a pair of lower arch portions 713.

The rib 711 of the lower housing 71 is a rib member extending along the sheet conveying direction on the upstream side in the sheet conveying direction than the drive roller 73. The rib 711 has a function of guiding a sheet toward the drive roller 73.

The lower opening portion 712 is an opening portion formed in the lower housing 71 to face the upper opening portion 703 of the upper housing 70. A drive roller portion 732 of the drive roller 73 is inserted in the lower opening portion 712 from below. The lower arch portion 713 is formed by processing a portion contiguous to the lower opening portion 712 in front and rear directions into an arch shape. A drive shaft 731 of the drive roller 73 is inserted in the paired lower arch portions 713. Further, a distal end of the drive shaft 731 is pivotally supported by an unillustrated bearing portion provided in the apparatus body 10 (see FIG. 1).

The driven roller 72 is mounted in the first insertion portion 701A and the second insertion portion 702A of the upper housing 70. The driven roller 72 is made of a resin material. The driven roller 72 is provided with the driven shaft 721 (shaft portions) and the driven roller portion 722 (a roller portion). The driven shaft 721 is constituted of a pair of shaft portions disposed at both ends of the driven roller 72 in front and rear directions. In other words, the driven shaft 721 projects from both surfaces of the driven roller portion 722. The driven shaft 721 extends in front and rear directions (in a direction perpendicularly intersecting with the sheet conveying direction), and serves as an axis of rotation of the driven roller 72. Both ends of the driven shaft 721 respectively project from the first insertion portion 701A and the second insertion portion 702A axially outwardly (in front and rear directions). The width of each of the first insertion portion 701A and the second insertion portion 702A in left and right directions is set to be slightly larger than the outer diameter of the driven shaft 721, but is set to be smaller than the outer diameter of a first ring portion 742R and a second ring portion 743R. This configuration makes it possible to prevent intrusion of the first ring portion 742R and the second ring portion 743R to be described later into the first insertion portion 701A and the second insertion portion 702A. The driven roller portion 722 is disposed between the paired shaft portions of the driven shaft 721. The driven roller portion 722 is inserted in the upper opening portion 703 of the upper housing 70. The driven roller 72 is rotated with the drive roller 73. The driven roller 72 faces the drive roller 73 across the sheet conveyance path SP.

The drive roller 73 is mounted in the paired lower arch portions 713 of the lower housing 71. The drive roller 73 is constituted of a portion made of a resin material and a portion made of a rubber material. The drive roller 73 is provided with the drive shaft 731 and the drive roller portion 732. The drive shaft 731 is constituted of a pair of shaft portions disposed at both ends of the drive roller 73 in front and rear directions. The drive shaft 731 extends in front and rear directions (in a direction perpendicularly intersecting with the sheet conveying direction), and serves as an axis of rotation of the drive roller 73. The drive shaft 731 is inserted in the paired lower arch portions 713. The drive roller portion 732 is disposed between the paired shaft portions of the drive shaft 731. The outer surface of the drive roller portion 732 is made of a rubber material. An unillustrated driving mechanism is coupled to the drive shaft 731 of the drive roller 73, and the drive roller 73 is driven and rotated by the driving mechanism. The drive roller 73 is driven and rotated by the arrow D31 direction in FIG. 3. As a result of the rotation of the drive roller 73, the driven roller 72 is rotated in the arrow D32 direction in FIG. 3. By the above configuration, a sheet to be conveyed along the sheet conveyance path SP is conveyed in the arrow DP direction in FIG. 3 as described above.

The wire spring 74 (a support member) is a bearing member which rotatably supports the driven roller 72. The wire spring 74 is made of a metal material. More specifically, the wire spring 74 is formed by bending or curving a metal wire member. The wire spring 74 is provided with the base end portion 741, a first spring portion 742 (an arm portion), and a second spring portion 743 (an arm portion).

The base end portion 741 is a base end of the wire spring 74. The base end portion 741 extends from a left end of the wire spring 74 in front and rear directions. The base end portion 741 is mounted between the left wall 704 and the engaging projecting portion 705 of the upper housing 70 (see FIG. 2).

The first spring portion 742 extends from a front end of the base end portion 741 rightwardly (toward the downstream side in the sheet conveying direction). The first spring portion 742 is provided with the first ring portion 742R (a ring portion) at a right end thereof. In other words, the first spring portion 742 extends leftwardly (toward the upstream side in the sheet conveying direction) from the first ring portion 742R. The first ring portion 742R is formed by bending a distal end (one end of the wire spring 74) of the first spring portion 742 into a ring shape (a circular shape) substantially by one turn. In forming the first ring portion 742R, a wound portion of the first ring portion 742R is disposed on the outer side (on the front side) in the sheet width direction. The inner diameter of the first ring portion 742R is set to such a size that the driven shaft 721 is rotatably inserted in accordance with the outer diameter of the driven shaft 721. Further, a first contact portion 742R1 (see FIG. 3), which is a downstream outer portion of the first ring portion 742R in the sheet conveying direction, is contacted with a first restriction wall 701H (a contact portion) of the front wall 701 (see FIG. 4). The first restriction wall 701H is part of the front wall 701 and protrudes from an inside surface of the front wall 701 toward the driven roller 72 so as to face the first ring portion 742R on a downstream side in the sheet conveying direction.

Likewise, the second spring portion 743 extends rightwardly from a rear end of the base end portion 741. The second spring portion 743 is provided with a second ring portion 743R (a ring portion) on a right end thereof. In other words, the second spring portion 743 extends leftwardly from the second ring portion 743R. The second ring portion 743R is formed by bending a distal end (the other end of the wire spring 74) of the second spring portion 743 into a ring shape substantially by one turn. A wound portion of the second ring portion 743R is disposed on the outer side (on the rear side) in the sheet width direction. The inner diameter of the second ring portion 743R is also set to such a size that the driven shaft 721 is rotatably inserted in accordance with the outer diameter of the driven shaft 721. Further, a second contact portion 743R1 (see FIG. 3), which is a downstream outer portion of the second ring portion 743R in the sheet conveying direction, is contacted with a second restriction wall 702H (a contact portion) of the rear wall 702 (see FIG. 4). The second restriction wall 702H is part of the rear wall 702 and protrudes from an inside surface of the rear wall 702 toward the driven roller 72 so as to face the second ring portion 743R on a downstream side in the sheet conveying direction. In other words, the first spring portion 742 and the second spring portion 743 are connected consecutively to each other by the base end portion 741 on the opposite side of the first ring portion 742R and the second ring portion 743R.

The first spring portion 742 and the second spring portion 743 of the wire spring 74 are supported by the upper housing 70 of the housing 7H. Left ends of the first spring portion 742 and the second spring portion 743 are respectively supported by the support wall portion 706 of the upper housing 70 (see FIG. 2). In other words, the left ends of the first spring portion 742 and the second spring portion 743 are pressed by the support wall portion 706 in such a direction as to be away from the sheet conveyance path SP. Further, a middle part of the first spring portion 742 and a middle part of the second spring portion 743 in left and right directions (a region between the left end of the first spring portion 742 and the first ring portion 742R, and a region between the left end of the second spring portion 743 and the second ring portion 743R) are respectively contacted with a lower end of the first claw portion 701B and a lower end of the second claw portion 702B. In other words, the middle parts of the first spring portion 742 and the second spring portion 743 are respectively pressed toward the sheet conveyance path SP by the first claw portion 701B and the second claw portion 702B.

Additionally commenting on the wire spring 74 and the driven roller 72, as shown in FIG. 3, the first ring portion 742R and the second ring portion 743R of the wire spring 74 are respectively mounted on the shaft portions of the driven shaft 721 of the driven roller 72. By the above configuration, the driven roller 72 is rotatably supported by the wire spring 74. As described above, the shaft portions of the driven shaft 721 of the driven roller 72 made of a resin material are respectively supported by the first ring portion 742R and the second ring portion 743R of the wire spring 74 made of a metal material. Accordingly, it is possible to suppress generation of noise caused by contact between resin members, which is accompanied by rotation of the driven roller 72.

The base end portion 741 of the wire spring 74 is received between the left wall 704 and the engaging projecting portion 705, while the driven roller portion 722 of the driven roller 72 is inserted in the upper opening portion 703 of the upper housing 70 from above (see FIG. 2 and FIG. 4). Simultaneously, the first spring portion 742 and the second spring portion 743 are respectively engaged with the lower ends of the first claw portion 701B and the second claw portion 702B (see FIG. 2 and FIG. 4). As described above, the wire spring 74 is formed of one wire member. Accordingly, the operator is allowed to temporarily make the first spring portion 742 and the second spring portion 743 close to each other, while holding the first spring portion 742 and the second spring portion 743 with his or her fingers, and then, is allowed to engage the first spring portion 742 and the second spring portion 743 with the lower ends of the first claw portion 701B and the second claw portion 702B, respectively.

The wire spring 74 while supporting the driven roller 72 is movable by a predetermined amount of tolerance in left and right directions (in the sheet conveying direction). Accordingly, the opening width of each of the first insertion portion 701A formed in the front wall 701 and the second insertion portion 702A formed in the rear wall 702 in left and right directions is set to be larger than the axial diameter of the driven shaft 721. By the above configuration, when the wire spring 74 is mounted in the upper housing 70, the left ends of the first spring portion 742 and the second spring portion 743 are supported by the support wall portion 706 from below. Further, the middle parts of the first spring portion 742 and the second spring portion 743 are respectively supported by the first claw portion 701B and the second claw portion 702B in such a direction as to be pressed downwardly (see FIG. 6). By the above configuration, the first ring portion 742R and the second ring portion 743R are pressed downwardly about the first claw portion 701B and the second claw portion 702B as a pivot axis by a resilient force resulting from resilient deformation of the first spring portion 742 and the second spring portion 743. As a result of the above operation, the driven roller 72 is pressed against the drive roller 73. In this way, the intermediate parts of the first spring portion 742 and the second spring portion 743 in left and right directions are respectively pressed downwardly by the first claw portion 701B and the second claw portion 702B, whereby the first spring portion 742 and the second spring portion 743 are flexed. A nip pressure to be applied from the driven roller 72 to the drive roller 73 is generated by a resilient force resulting from the flexure.

Further, when the drive roller 73 is driven and rotated by the unillustrated driving mechanism, the driven roller 72 is rotated with the drive roller 73. During the rotation of the driven roller 72, the driven roller 72 is moved rightwardly (toward the downstream side in the sheet conveying direction) by the rotational force of the drive roller 73. As a result of the above operation, the first contact portion 742R1 of the first ring portion 742R and the second contact portion 743R1 of the second ring portion 743R are respectively contacted with the first restriction wall 701H of the front wall 701 and the second restriction wall 702H (see FIG. 4) of the rear wall 702. The above configuration makes it possible to stably position the driven roller 72 in up and down directions and in left and right directions, and to stably form a nip portion between the driven roller 72 and the drive roller 73. On the other hand, in the case where an abrupt external force is applied to the driven roller 72 during conveyance of a sheet, the wire spring 74 supporting the driven roller 72 is movable leftwardly by a predetermined amount of tolerance. The above configuration makes it possible to prevent application of an excessive load on the driven roller 72 and on the wire spring 74 due to the external force, whereby breakage and/or deformation of the driven roller 72 and the wire spring 74 are avoided.

In particular, the first contact portion 742R1 of the first ring portion 742R and the second contact portion 743R1 of the second ring portion 743R on the downstream side in the sheet conveying direction are contacted with the upper housing 70. Accordingly, it is possible to keep the first contact portion 742R1 and the second contact portion 743R1 in contact with the upper housing 70 by rotation of the driven roller 72. Further, the first ring portion 742R and the second ring portion 743R are made of a metal material, and the driven shaft 721 of the driven roller 72 is made of a resin material. The above configuration is advantageous in suppressing generation of noise caused by contact between resin members, which may occur as the resin members are used for a long period of time.

Further, according to the embodiment, the wire spring 74 is formed of one wire member. This is advantageous in reducing the cost of a member for supporting the driven roller 72. In particular, bending an end of a wire member constituting the wire spring 74 is advantageous in forming a bearing portion (the first ring portion 742R, the second ring portion 743R) for supporting the driven shaft 721 of the driven roller 72 with a simplified construction and at a low cost.

Further, according to the embodiment, the driven roller 72 is pressed against the drive roller 73 about the first claw portion 701B and the second claw portion 702B of the upper housing 70 as a pivot axis. Further, the wire spring 74 is movable toward the upstream side in the sheet conveying direction in a state that the wire spring 74 is pressed by the first claw portion 701B, the second claw portion 702B, and the support wall portion 706. This makes it possible to rotate the driven roller 72 while keeping the first ring portion 742R and the second ring portion 743R in contact with the upper housing 70, and to move the wire spring 74 toward the upstream side in the sheet conveying direction, in the case where an abrupt external force is applied to the driven roller 72.

In the foregoing, there have been described the conveyance unit 7 and the image forming apparatus 1 provided with the conveyance unit 7 embodying the present disclosure. The present disclosure is not limited to the above, and the following modifications may be applied.

(1) In the embodiment, the conveyance unit 7 is disposed between the switchback conveyance path 50C and the inversion conveyance path 50B out of the conveyance path in the image forming apparatus 1. The present disclosure is not limited to the above. The conveyance unit 7 may be disposed at any position in the image forming apparatus 1, as far as the conveyance unit 7 can convey a sheet.

(2) Further, the conveyance unit 7 may be disposed in the automatic document feeder (ADF) 20. Specifically, the conveyance unit 7 may automatically feed a document sheet toward a predetermined document reading position in the apparatus body 10. Then, the reading unit 25 may read a document image of the document sheet. In the above modification, an image reading device is constituted of the automatic document feeder (ADF) 20 including the conveyance unit 7, and the reading unit 25. Further, an image is formed on a sheet by the image forming assembly 30 in accordance with an image read by the image reading device. Even in such a case, the position of the driven roller 72 is stably held by the wire spring 74. Accordingly, the above configuration is advantageous in stably conveying a document along the sheet conveyance path SP, and in stably reading an image of the document by the reading unit 25. Further, the above configuration is advantageous in suppressing generation of noise caused by contact between resin members, which may occur as the resin members are used for a long period of time. Furthermore, the above configuration is advantageous in stably forming an image on a sheet in accordance with the document image.

(3) In the embodiment, the first spring portion 742 and the second spring portion 743 extend along the sheet conveyance path SP. The present disclosure is not limited to the above. The first spring portion 742 and the second spring portion 743 may be supported on the upper housing 70 with a predetermined angle with respect to the sheet conveyance path SP. Further, the first spring portion 742 and the second spring portion 743 may be individually supported on the upper housing 70, without being connected consecutively to each other. Furthermore, the paired shaft portions of the driven shaft 721 may be formed of one shaft extending through the driven roller portion 722.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. A sheet conveying device, comprising:

a housing provided with a contact portion;

a sheet conveyance path extending in the housing, and in which a sheet is conveyed in a predetermined conveying direction;

a drive roller supported by the housing, and configured to convey the sheet in the conveying direction by being driven and rotated;

a driven roller made of a resin material, the driven roller provided with a roller portion, and a pair of shaft portions projecting from both side surfaces of the roller portion, the driven roller being disposed to face the drive roller across the sheet conveyance path, and being rotated around the shaft portions with the drive roller; and a support member made of a metal material, the support member including a pair of ring portions through which each of the shaft portions is inserted, and a pair of arm portions extending in one direction from the paired ring portions and being supported on the housing, the support member rotatably supporting the driven roller, wherein the driven roller is rotated with the drive roller in a state that a downstream outer portion of the ring portion in the conveying direction is contacted with the contact portion of the housing.

2. The sheet conveying device according to claim 1, wherein the support member is provided with a connecting portion which consecutively connects upstream ends of the paired arm portions in the conveying direction to each other, the support member is formed of one wire member, and the paired ring portions are formed by bending both ends of the wire member into a circular shape.

3. The sheet conveying device according to claim 1, wherein the arm portion extends from the ring portion toward an upstream side in the conveying direction, the housing has a first support portion which supports an upstream end of the arm portion in the conveying direction in a direction away from the sheet conveyance path, and a second support portion which supports a region between the upstream end of the arm portion and the ring portion in a direction toward the sheet conveyance path, and the support member is configured to press the driven roller toward the drive roller in a state that the support member is supported by the first support portion and the second support portion and is elastically deformed, and is movable toward the upstream side in the conveying direction.

4. The sheet conveying device according to claim 3, wherein the housing includes a plate portion disposed to face the sheet conveyance path;

a first opening portion formed in the plate portion for receiving the roller portion of the driven roller therein;

a pair of first wall portions extending upright from the plate portion along the conveying direction so as to sandwich the first opening portion therebetween; and a pair of second opening portions respectively formed in the paired first wall portions for receiving the shaft portions of the driven roller therein;

the second support portion consists of a pair of portions disposed in the paired first wall portions to face each other.

5. The sheet conveying device according to claim 4, wherein the housing includes:

a second wall portion extending upright from the plate portion on the upstream side in the conveying direction than the first wall portion; and a projecting portion projecting from the plate portion at a position away from the second wall portion by a predetermined distance, the support member is provided with a connecting portion which consecutively connects upstream ends of the paired arm portions in the conveying direction to each other, and the connecting portion is mounted in a space between the second wall portion and the projecting portion.

6. The sheet conveying device according to claim 4, wherein the contact portion is part of a wall surface of the first wall portion, the contact portion protruding from an inside surface of the first wall portion toward the driven roller so as to face the ring portion on a downstream side in the conveying direction.

7. An image forming apparatus, comprising:

a sheet conveying device which conveys a sheet; and an image forming assembly which forms an image on the sheet, the sheet conveying device including:

a housing provided with a contact portion;

a sheet conveyance path extending in the housing, and in which a sheet is conveyed in a predetermined conveying direction;

a drive roller supported by the housing, and configured to convey the sheet in the conveying direction by being driven and rotated;

a driven roller made of a resin material, the driven roller provided with a roller portion, and a pair of shaft portions projecting from both side surfaces of the roller portion, the driven roller being disposed to face the drive roller across the sheet conveyance path, and being rotated around the shaft portions with the drive roller; and a support member made of a metal material, the support member including a pair of ring portions through which each of the shaft portions is inserted, and a pair of arm portions extending in one direction from the paired ring portions and being supported on the housing, the support member rotatably supporting the driven roller, wherein the driven roller is rotated with the drive roller in a state that a downstream outer portion of the ring portion in the conveying direction is contacted with the contact portion of the housing.

8. The image forming apparatus according to claim 7, wherein the support member is provided with a connecting portion which consecutively connects upstream ends of the paired arm portions in the conveying direction to each other, the support member is formed of one wire member, and the paired ring portions are formed by bending both ends of the wire member into a circular shape.

9. The image forming apparatus according to claim 7, wherein the arm portion extends from the ring portion toward an upstream side in the conveying direction, the housing has a first support portion which supports an upstream end of the arm portion in the conveying direction in a direction away from the sheet conveyance path, and a second support portion which supports a region between the upstream end of the arm portion and the ring portion in a direction toward the sheet conveyance path, and the support member is configured to press the driven roller toward the drive roller in a state that the support member is supported by the first support portion and the second support portion and is elastically deformed, and is movable toward the upstream side in the conveying direction.

10. The image forming apparatus according to claim 9, wherein the housing includes a plate portion disposed to face the sheet conveyance path;

a first opening portion formed in the plate portion for receiving the roller portion of the driven roller therein;

a pair of first wall portions extending upright from the plate portion along the conveying direction so as to sandwich the first opening portion therebetween; and a pair of second opening portions respectively formed in the paired first wall portions for receiving the shaft portions of the driven roller therein;

the second support portion consists of a pair of portions disposed in the paired first wall portions to face each other.

11. The image forming apparatus according to claim 10, wherein the housing includes:

a second wall portion extending upright from the plate portion on the upstream side in the conveying direction than the first wall portion; and a projecting portion projecting from the plate portion at a position away from the second wall portion by a predetermined distance, the support member is provided with a connecting portion which consecutively connects upstream ends of the paired arm portions in the conveying direction to each other, and the connecting portion is mounted in a space between the second wall portion and the projecting portion.

12. The image forming apparatus according to claim 10, wherein the contact portion is part of a wall surface of the first wall portion, the contact portion protruding from an inside surface of the first wall portion toward the driven roller so as to face the ring portion on a downstream side in the conveying direction.

13. An image reading device, comprising:

a sheet conveying device which conveys a sheet having a document image to a predetermined document reading position; and a reading mechanism which reads the document image at the document reading position, the sheet conveying device including:

a housing provided with a contact portion;

a sheet conveyance path extending in the housing, and in which a sheet is conveyed in a predetermined conveying direction;

a drive roller supported by the housing, and configured to convey the sheet in the conveying direction by being driven and rotated;

a driven roller made of a resin material, the driven roller provided with a roller portion, and a pair of shaft portions projecting from both side surfaces of the roller portion, the driven roller being disposed to face the drive roller across the sheet conveyance path, and being rotated around the shaft portions with the drive roller; and a support member made of a metal material, the support member including a pair of ring portions through which each of the shaft portions is inserted, and a pair of arm portions extending in one direction from the paired ring portions and being supported on the housing, the support member rotatably supporting the driven roller, wherein the driven roller is rotated with the drive roller in a state that a downstream outer portion of the ring portion in the conveying direction is contacted with the contact portion of the housing.

14. The image reading device according to claim 13, wherein the support member is provided with a connecting portion which consecutively connects upstream ends of the paired arm portions in the conveying direction to each other, the support member is formed of one wire member, and the paired ring portions are formed by bending both ends of the wire member into a circular shape.

15. The image reading device according to claim 13, wherein the arm portion extends from the ring portion toward an upstream side in the conveying direction, the housing has a first support portion which supports an upstream end of the arm portion in the conveying direction in a direction away from the sheet conveyance path, and a second support portion which supports a region between the upstream end of the arm portion and the ring portion in a direction toward the sheet conveyance path, and the support member is configured to press the driven roller toward the drive roller in a state that the support member is supported by the first support portion and the second support portion and is elastically deformed, and is movable toward the upstream side in the conveying direction.

16. The image reading device according to claim 15, wherein the housing includes a plate portion disposed to face the sheet conveyance path;

a first opening portion formed in the plate portion for receiving the roller portion of the driven roller therein;

a pair of first wall portions extending upright from the plate portion along the conveying direction so as to sandwich the first opening portion therebetween; and a pair of second opening portions respectively formed in the paired first wall portions for receiving the shaft portions of the driven roller therein;

the second support portion consists of a pair of portions disposed in the paired first wall portions to face each other.

17. The image reading device according to claim 16, wherein the housing includes:

a second wall portion extending upright from the plate portion on the upstream side in the conveying direction than the first wall portion; and a projecting portion projecting from the plate portion at a position away from the second wall portion by a predetermined distance, the support member is provided with a connecting portion which consecutively connects upstream ends of the paired arm portions in the conveying direction to each other, and the connecting portion is mounted in a space between the second wall portion and the projecting portion.

18. The image reading device according to claim 16, wherein the contact portion is part of a wall surface of the first wall portion, the contact portion protruding from an inside surface of the first wall portion toward the driven roller so as to face the ring portion on a downstream side in the conveying direction.

* * * * *